US007187111B1

(12) United States Patent
Johanning

(10) Patent No.: US 7,187,111 B1
(45) Date of Patent: Mar. 6, 2007

(54) SYSTEM AND METHOD FOR SUPPORTING ARC TUBES IN HID LAMPS

(75) Inventor: Jeffrey L. Johanning, Hudson, OH (US)

(73) Assignee: Advanced Lighting Technologies, Inc., Solon, OH (US)

( * ) Notice: Subject to any disclaimer, the term of this patent is extended or adjusted under 35 U.S.C. 154(b) by 0 days.

(21) Appl. No.: 09/534,443

(22) Filed: Mar. 24, 2000

Related U.S. Application Data

(60) Provisional application No. 60/125,999, filed on Mar. 24, 1999.

(51) Int. Cl.
*H01J 1/92* (2006.01)

(52) U.S. Cl. ..... 313/238; 313/269; 313/285; 313/290

(58) Field of Classification Search ..... 313/45–47, 313/25, 292, 240–242, 326, 352, 479, 252, 313/266, 290, 283–287, 238, 269, 285
See application file for complete search history.

(56) References Cited

U.S. PATENT DOCUMENTS 2,749,461 A 6/1956 Hierholzer et al.
3,094,640 A 6/1963 Gustin
4,689,518 A 8/1987 King
4,990,819 A 2/1991 Narby et al.
5,126,619 A 6/1992 Wakimizu et al.
5,173,632 A * 12/1992 Dolan et al. ..... 313/25
5,212,422 A 5/1993 Topel, Jr. et al.
5,250,872 A 10/1993 Wakimizu et al.
5,612,585 A 3/1997 Verschueren
6,008,566 A * 12/1999 Brown et al. ..... 313/25
6,153,968 A 11/2000 Dombrowski et al.
6,188,164 B1 * 2/2001 Brown et al. ..... 313/25
6,249,077 B1 * 6/2001 Brown et al. ..... 313/25
6,575,415 B1 * 6/2003 Williamson ..... 248/205.1

FOREIGN PATENT DOCUMENTS

WO WO 91/09415 6/1991

* cited by examiner

*Primary Examiner*—Ashok Patel
(74) *Attorney, Agent, or Firm*—Duane Morris, LLP

(57) ABSTRACT

A mounting structure for an arc tube within an outer envelope of an HID lamp, including an elongated frame supported at one end by a stem assembly and a stem clamp having one or more frame retaining tabs crimped around a portion of the frame.

15 Claims, 19 Drawing Sheets

SYSTEM AND METHOD FOR SUPPORTING ARC TUBES IN HID LAMPS

CLAIM OF PRIORITY

This application claims the priority of U.S. Provisional Patent Application Ser. No. 60/125,999 filed Mar. 24, 1999.

BACKGROUND OF THE INVENTION

The present invention relates to systems and methods for mechanically supporting and electrically coupling arc tubes in high intensity discharge ("HID") lamps such as metal halide lamps. More particularly, the invention relates to such systems and methods which provide mechanical support and electrical coupling of the arc tube in an HID lamp with few or no welds.

HID lamps such as metal halide lamps have found widespread acceptance in lighting large outdoor and indoor areas such as athletic stadiums, gymnasiums, warehouses, parking facilities, and the like, because of the relatively high efficiency, compact size, and low maintenance of HID lamps when compared to other lamp types. A typical HID lamp includes an arc tube which is mechanically supported within a light-transmissive outer lamp envelope. The arc tube includes two or more electrical leads which are each electrically coupled to a source of electrical power exterior of the outer lamp envelope.

In such a lamp, the mounting structure which provides mechanical support and electrical coupling for the arc tube within the outer lamp envelope includes one or more metal components which are welded for mechanical and electrical integrity. In the fabrication of such lamps, the practice of welding such components, unless automated, is labor intensive which adds expense to the fabrication process. Further, the welding of various lamp components requires numerous weld schedules for the components which may comprise different materials and geometries. Still further, the welding electrodes require a significant amount of maintenance to achieve an optimum weld. Thus the elimination of welds in the mounting structure for the arc tube is desirable to reduce the time and expense required to fabricate such lamps.

Another disadvantage of the typical HID lamp mounting structure having welds to maintain the mechanical and electrical integrity of the structure results from the susceptibility of the one or more welds in such lamps to mechanical failure during shipping of the lamps. The welds provide a relatively strong mechanical coupling of components when the weld is subjected to shear. However, the welds are relatively weak when subjected to a bending moment, which is the typical mode of mechanical failure in such lamps during shipping.

In the fabrication of HID lamps, it is important to properly position the arc tube within the outer lamp envelope so that the light center of the lamp is optimized. In the known methods of fabricating HID lamps, the various components of the arc tube mounting structure must be aligned manually by the production operator before being mechanically joined or fixtured with specialized tooling. Such an alignment process is time consuming if done manually and expensive if done using fixtures. Thus the elimination of the alignment process in the fabrication of HID lamps is desirable to reduce the time and expense required to fabricate such lamps.

Accordingly, it is an object of the present invention to provide a novel system and method for mechanically supporting and electrically coupling arc tubes in HID lamps which obviates the deficiencies of known systems and methods.

It is another object of the present invention to provide a novel system and method for mechanically supporting and electrically coupling arc tubes in HID lamps with few or no components which are welded for mechanical integrity.

It is yet another object of the present invention to provide a novel system and method for mechanically supporting and electrically coupling arc tubes in HID lamps with few or no components which are welded for electrical integrity.

It is still another object of the present invention to provide a novel system and method for mechanically supporting and electrically coupling arc tubes in HID lamps which is amenable to automation.

It is a further object of the present invention to provide a novel system and method for mechanically supporting and electrically coupling arc tubes in HID lamps which reduces mechanical failure during shipping of the lamp.

It is yet a further object of the present invention to provide a novel system and method for aligning the light center of an HID lamp.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

While the present invention is suitable for mechanically supporting and electrically coupling arc tubes in any type of HID lamp, it may be easily understood in the embodiment suitable for metal halide lamps.

Figure 1A:
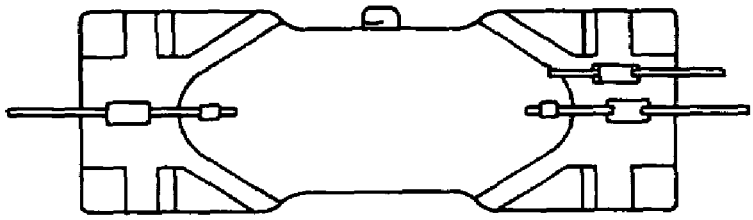
FIG. 1*a* is a schematic illustrating a front view of a prior art pinched body arc tube.
Figure 1B:
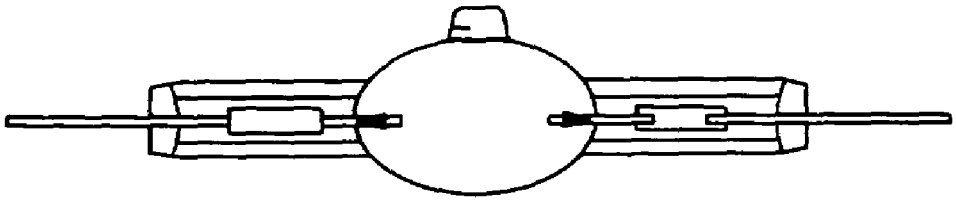
FIG. 1*b* is a schematic illustrating a front view of a prior art formed body arc tube.

Metal halide lamps include light emitting chemicals which are hermetically sealed within an arc tube formed from light transmitting material such as quartz glass or ceramics. The arc tube may comprise a pinched body or a formed body as illustrated in FIGS. 1*a* and 1*b* respectively. The arc tube must be mechanically supported and electrically coupled within the outer lamp envelope and there are many known configurations for the arc tube mounting structure. However, there are only two basic types of arc tube mounting structures, i.e., enclosed (unshrouded) and open (shrouded). The open fixtures include a generally tubular shroud formed from light transmitting material positioned around the arc tube. The shroud provides protection in the unlikely event of a non-passive failure of the arc tube.

There are many sizes of metal halide lamps which range between about 32 watts and 2000 watts and generally include either a medium type base for lower wattage lamps (150 W or below) or a mogul type base for higher wattage lamps (175 W or greater).

Figure 2A:
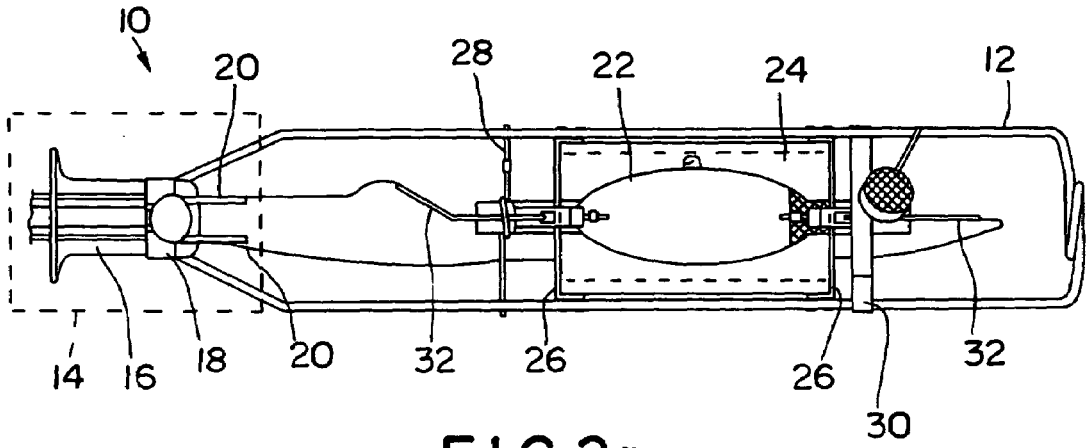
FIG. 2*a* is a schematic illustrating a front view of a prior art mounting structure for a 400 watt metal halide lamp.
Figure 2B:
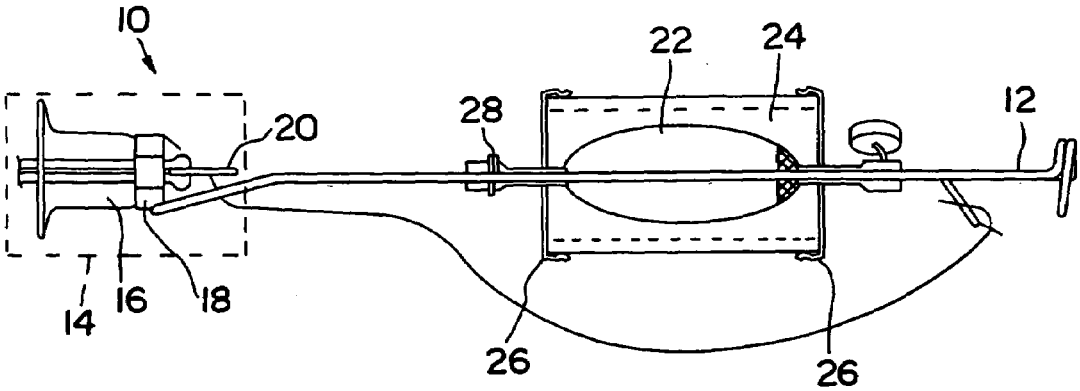
FIG. 2*b* is a bottom view of FIG. 2*a*.

FIGS. 2*a* and 2*b* illustrate a typical prior art mounting structure for providing mechanical support and electrical coupling for a shrouded formed body arc tube in a 400 watt metal halide lamp having a mogul type base. With reference to FIGS. 2*a* and 2*b*, the arc tube mounting structure 10 includes a metal frame 12 which is mechanically supported by a stem assembly 14. The stem assembly 14 comprises a stem 16 which is typically formed from hard glass, a metallic spring clip 18, and two stem leads 20 which provide an electrical coupling between the arc tube 22 supported within the outer lamp envelope (not shown) to a source of electrical power (not shown) for operating the lamp.

The frame 12 is mechanically supported at one end by the stem assembly 14. The integrity of the mechanical support of the frame 12 by the stem assembly 14 is maintained by one or more welds between the frame 12 and the spring clip 18.

The arc tube 22 is mechanically supported at one end by an arc tube retaining clip 28 and at the other end by a strap 30. The retaining clip 28 and strap 30 are each mechanically supported from the frame 12. The integrity of the mechanical support of the retaining clip 28 and strap 30 from the frame 12 is maintained by one or more welds.

The generally tubular shroud 24 surrounds the central portion of the arc tube 22 and is mechanically supported at each end by a shroud cap 26. Each of the shroud caps 26 is mechanically supported from the frame 12. The integrity of the mechanical support of the shroud caps 26 from the frame 12 is maintained by one or more welds.

The arc tube 22 includes an arc tube lead 32 at each end. Each arc tube lead 32 is electrically coupled to one of the stem leads 20. The integrity of the electrical coupling between the arc tube leads 32 and the stem leads 20 is maintained by one or more welds.

While of utility in HID lamps of any type and wattage, the present invention may be easily understood in the embodiments suitable for mechanically supporting and electrically coupling the arc tubes of metal halide lamps.

Figure 3A:
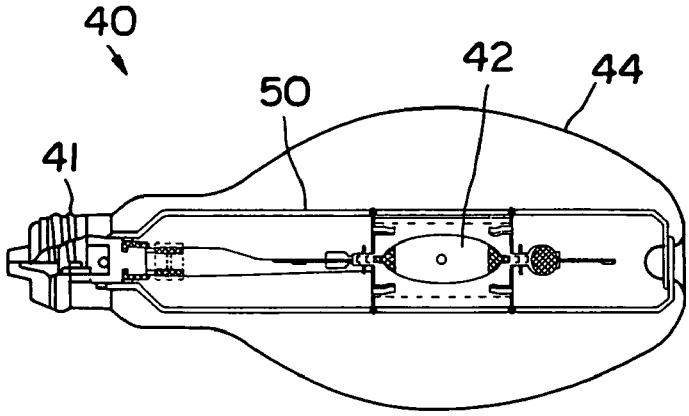
FIG. 3*a* is a schematic illustrating a front view of a 350 watt open fixture metal halide lamp according to one aspect of the present invention.
Figure 3B:
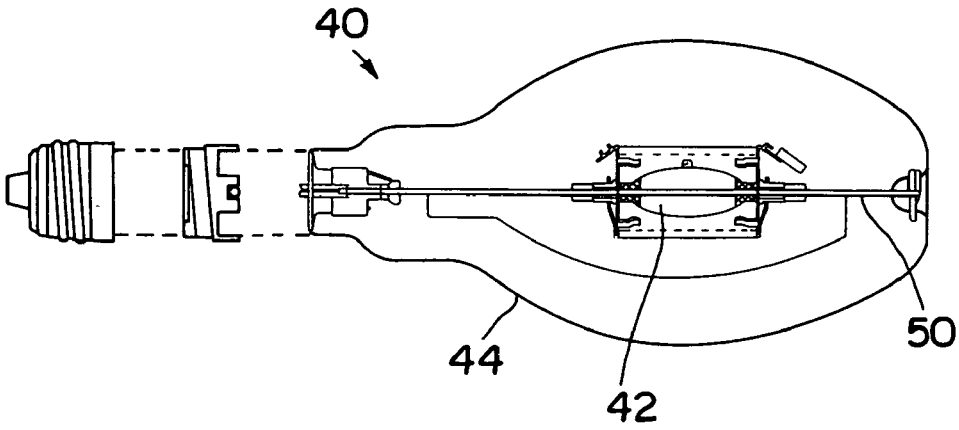
FIG. 3*b* is a bottom view of FIG. 3*a*.

Open Fixture Lamps:

FIGS. 3*a* and 3*b* illustrate a 350 watt open fixture metal halide lamp. With reference to FIGS. 3*a* and 3*b*, the lamp 40 includes a formed body arc tube 42 which is mechanically supported and electrically coupled within the outer lamp envelope 44 by the mounting structure 50.

Figure 4A:
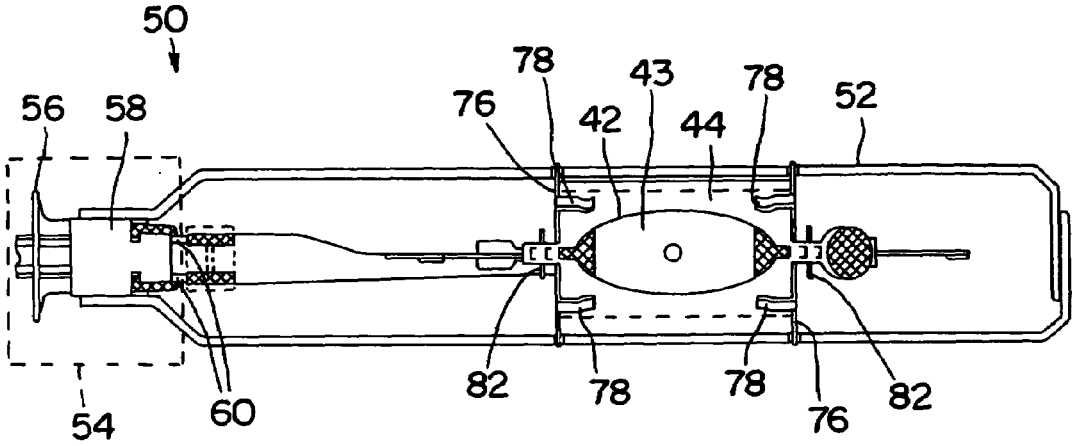
FIG. 4*a* is a schematic illustrating a front view of the mounting structure of the lamp illustrated in FIG. 3.
Figure 4B:
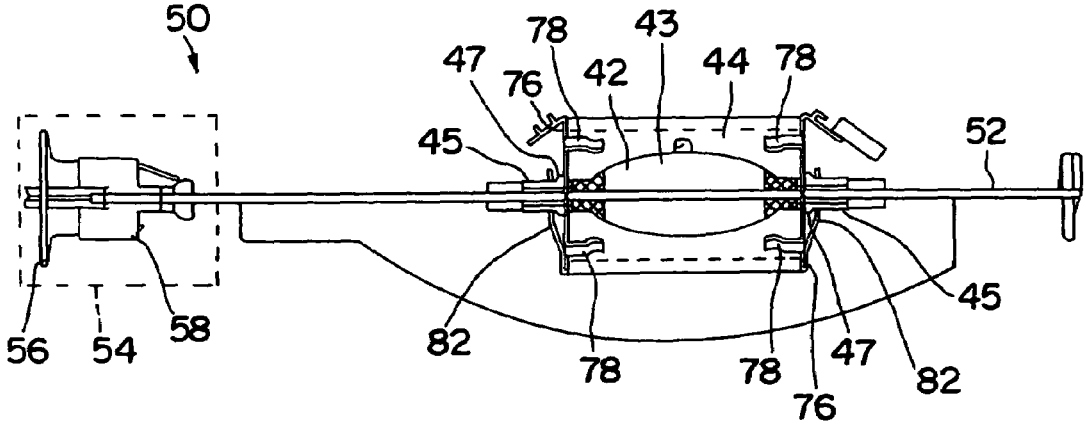
FIG. 4*b* is a bottom view of FIG. 4*a*.

FIGS. 4*a* and 4*b* illustrate the arc tube mounting structure for the lamp illustrated in FIGS. 3*a* and 3*b*. With reference to FIGS. 4*a* and 4*b*, the mounting structure 50 comprises a frame 52 which is mechanically supported by the stem assembly 54. The stem assembly 54 comprises a stem 56 which may be formed from hard glass, a metallic stem clamp 58, and two stem leads 60 which provide an electrical coupling between the arc tube 42 supported within the outer lamp envelope (not shown) and a source of electrical power (not shown) for operating the lamp.

The frame 52 is mechanically supported at one end by the stem assembly 54. In one embodiment of the present invention, the integrity of the mechanical support of the frame 52 by the stem assembly 54 is maintained without a weld.

Figure 5A:
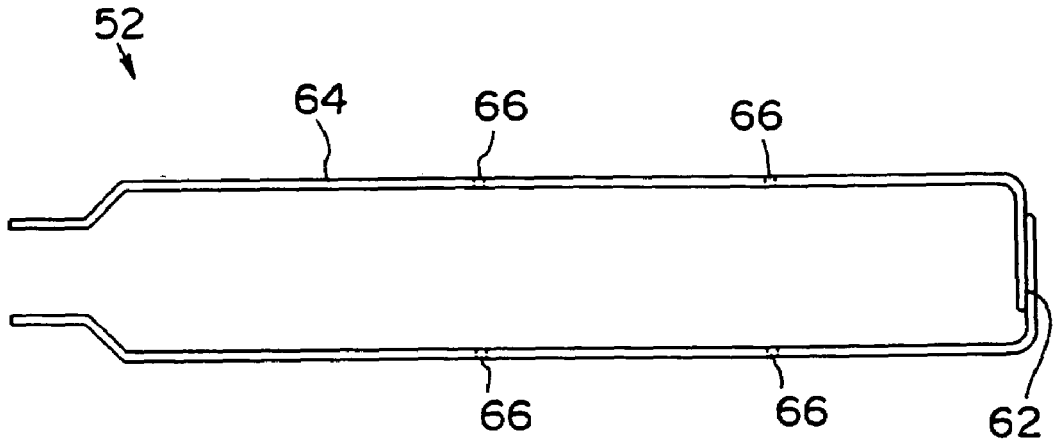
FIG. 5*a* is a schematic illustrating one embodiment of the frame suitable for the mounting structure illustrated in FIG. 4.
Figure 5B:
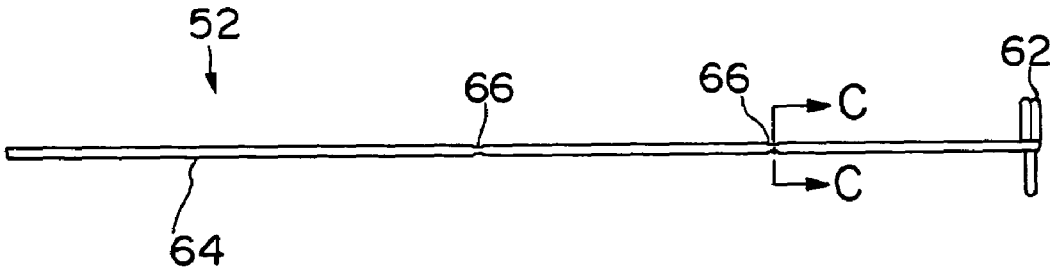
FIG. 5*b* is a bottom view of FIG. 5*a*.
Figure 5C:
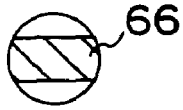
FIG. 5*c* is a section of FIG. 5*b*.

FIGS. 5*a* and 5*b* illustrate one embodiment of the frame according to the present invention. With reference to FIGS. 5*a* and 5*b*, the frame 52 comprises a metallic wire formed into an end portion 62 and a pair of generally parallel legs 64 extending in substantially the same direction from the end portion 62. Each leg 64 includes one or more swaged portions 66 at predetermined locations along the length thereof. FIG. 5*c* illustrates an enlarged cross-section of the leg 64 at a swaged portion 66 thereof.

Figure 6A:
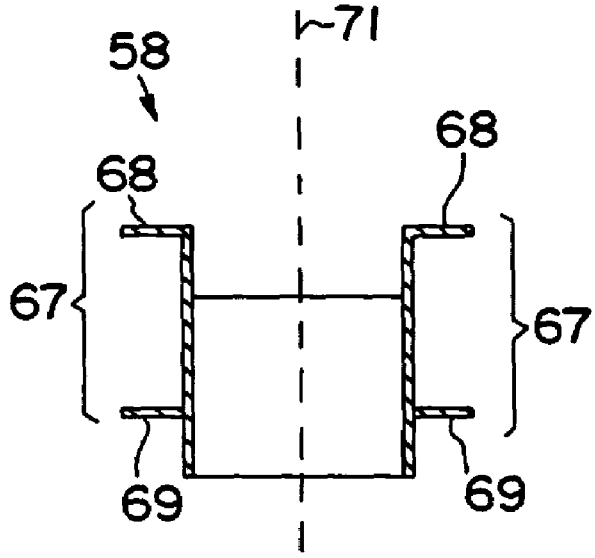
FIG. 6*a* is a schematic illustrating one embodiment of the stem clamp suitable for the mounting structure illustrated in FIG. 4.
Figure 6B:
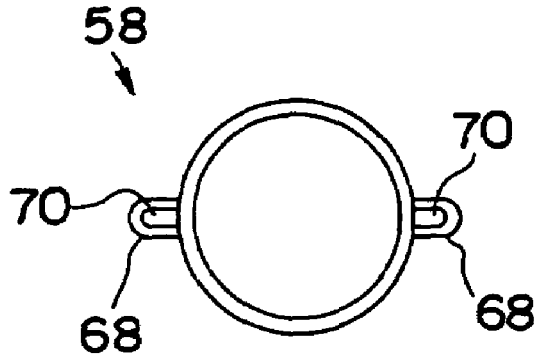
FIG. 6*b* is a bottom view of FIG. 6*a*.

FIGS. 6*a* and 6*b* illustrate one embodiment of the stem clamp according to the present invention. With reference to FIGS. 6*a* and 6*b*, the stem clamp 58 is a generally tubular metallic clamp which is adapted to fit over the stem 56 as illustrated in FIGS. 4*a* and 4*b*. The stem clamp 58 includes two pairs of frame retaining tabs 67, each pair having an upper tab 68 and lower tab 69 and being positioned opposite the other pair about the curved surface of the stem clamp 58. Each retaining tab 68,69 forms an aperture 70 and is adapted to receive therethrough a portion of one of the legs 64 adjacent the terminal end thereof. Each pair of frame retaining tabs 67 is aligned so that the leg 64 received therethrough is substantially parallel to the longitudinal axis 71 of the stem clamp 58.

The frame 52 may be mechanically supported by the stem assembly 54 by positioning each leg 64 through the apertures 70 formed by the upper tab 68 and the lower tab 69 of one of the pairs of retaining tabs 67. Each pair of retaining tabs 67 laterally constrains the leg 64 received therethrough. With further reference to FIG. 3*a*, the rigid attachment between the outer lamp envelope 44 and the lamp base 41 axially constrains the mounting structure 50 supported therein. The integrity of the mechanical support of the frame 52 by the stem assembly 54 is maintained by axial constraint of the frame 52 after the terminal ends thereof are received through the pairs of retaining tabs 67. Thus the integrity of the mechanical support of the frame 52 from the stem assembly 54 may include no welds.

With further reference to FIGS. 4*a*, 4*b*, 5*a* and 5*b*, the arc tube 42 and the shroud 44 may be mechanically supported at each end by a shroud cap 76. Each shroud cap 76 is mechanically supported by the frame 52. In one embodiment of the present invention, the integrity of the mechanical support of one or both shroud caps 76 is maintained without a weld.

Figure 7:
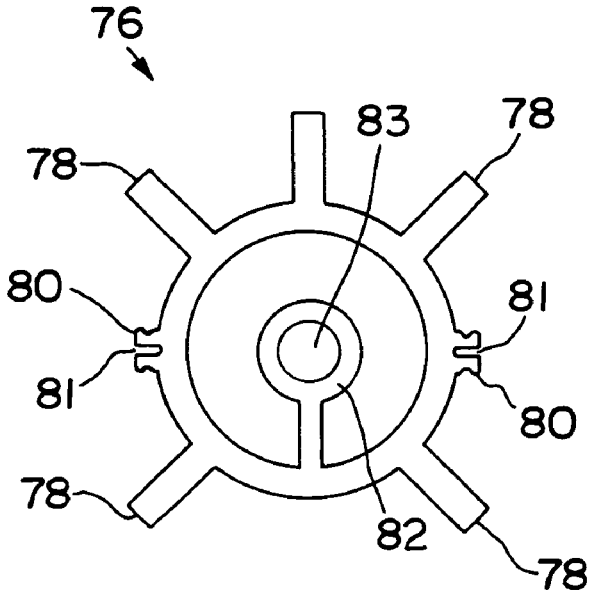
FIG. 7 is a schematic illustrating a top view of a shroud cap suitable for the mounting structure illustrated in FIG. 4.

FIG. 7 illustrates a shroud cap of one embodiment of the present invention. With reference to FIG. 7, the shroud cap 76 is a generally planar member having a generally circular shape and comprises one or more shroud retaining tabs 78 positioned about the circumference thereof, two frame retaining tabs 80 each positioned opposite the other about the circumference thereof, and a central arc tube retaining tab 82 positioned at or about the center thereof.

Each frame receiving tab 80 forms a slot 81 which is adapted to receive therein a swaged portion 66 of one of the legs 64 of the frame 52. The swaged portions 66 on each leg 64 are positioned so that when received in the frame receiving tabs 80 of the shroud cap 76, the shroud cap may be mechanically supported between the legs 64 at a substantially right angle thereto. The integrity of the mechanical support may be maintained by crimping the tabs 80 about the swaged portion 66 received therein. The integrity of the mechanical support is further maintained by the lateral constraint of the terminal ends of the legs 64 by the stem assembly 54. Thus the integrity of the mechanical support of one or both of the shroud caps 76 from the frame 52 may be maintained without a weld.

The shroud 44 is a generally tubular member formed from light transmitting material. The shroud may be mechanically supported at each end by positioning the shroud 44 between each shroud cap 76 so that the longitudinal axis of the shroud 44 is substantially parallel to each leg 64. The integrity of the mechanical support of the shroud 44 between each shroud cap 76 may be maintained by bending the shroud retaining tabs 78 to be in contact with the outer surface of the shroud 44 as illustrated in FIGS. 4*a* and 4*b*.

The arc tube 42 includes a bulbous light emitting chamber 43 between two end portions 45. The arc tube 42 may be supported at each end portion 45 by the arc tube retaining tab 82 of one of the shroud caps 76. Each tab 82 forms an aperture 83 adapted to receive a portion of one end portion 45 of the arc tube 42 therethrough. The arc tube 42 is positioned between the tabs 82 of each shroud cap 76 so that the longitudinal axis of the arc tube 42 is substantially parallel to the legs 64 of the frame 52.

Each end portion 45 of the arc tube 42 includes an axial positioning portion 47 which is of larger cross-sectional dimension than the end portion 45. The cross-sectional dimension of the axial positioning portion 47 is large enough to prevent the passage of the axial positioning portion 47 through the aperture 83 of tab 82 of each shroud cap 76. The shroud caps 76 may thus be spaced apart a distance to prevent axial movement of the arc tube 42 supported therebetween.

The arc tube 42 forms the light emitting chamber of the lamp, and thus the axial positioning of the arc tube is critical in optimizing the light center of the lamp. Thus the light center of the lamp may be determined by positioning the swaged portions 66 of the legs 64 which thus determines the axial position of the shroud caps 76, which thus determines the axial position of the arc tube 42. This method of aligning the light center of the lamp eliminates the time consuming process of manually aligning the arc tube during fabrication of the lamp.

Figure 8A:
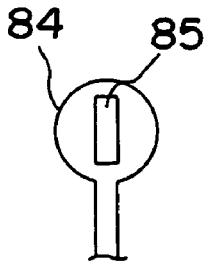
FIGS. 8*a* and 8*b* are schematics illustrating different embodiments of the arc tube retaining tabs suitable for the shroud cap illustrated in FIG. 7.
Figure 8B:
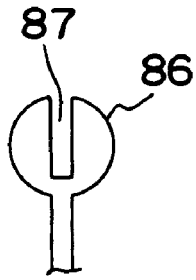

In some lamps, the radial position of the arc tube is critical to the operation of the lamp. In such lamps having formed body arc tube as illustrated in FIG. 1*b*, the end portions of the arc tube may terminate at the pinched region which is flattened. the cross-section of the terminal portion of the end portions of the arc tube will not rotate relative to an aperture or slot having a similar geometry if inserted therethrough. FIGS. 8*a* and 8*b* illustrate yet other embodiments of the arc tube retaining tabs according to the present invention. With reference to FIGS. 8*a* and 8*b*, the tab 84 forms an elongated aperture 85 adapted to receive the flattened end portion of an arc tube. The tab 86 forms an elongated slot 87 adapted to receive the flattened end portion of an arc tube. The dimension of the aperture 85 and slot 87 may be adapted to prevent rotation of the end portion of the arc tube received therethrough. Thus the arc tube may be radially aligned by positioning the elongated dimension of the aperture 85 or slot 87 and thus radially positioning the arc tube supported by the tabs 84,86.

Electrical Coupling:

In addition to providing mechanical support for the arc tube in HID lamps, the mounting structure provides electrical coupling of the arc tube to a source of electrical power for operating the lamp. The aspect of the present invention directed to the electrical coupling of the arc tube to a power source is suitable for any type HID lamp and may be easily understood in the embodiment for open fixture metal halide lamps.

Figure 9A:
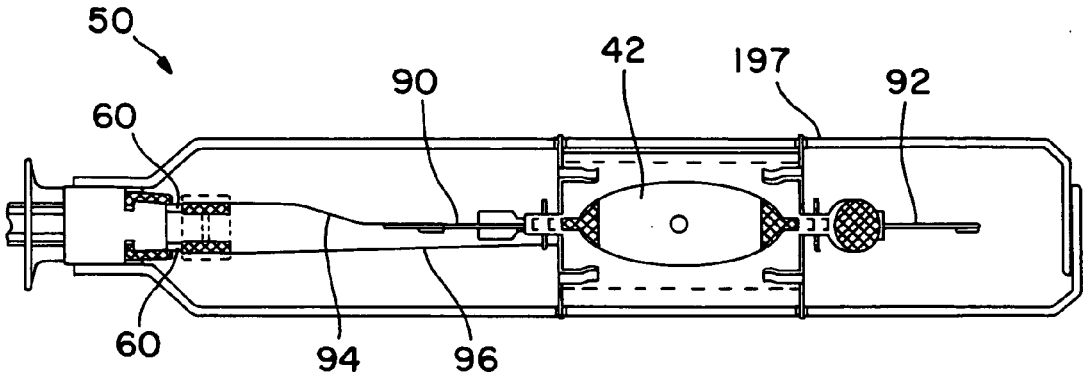
FIG. 9*a* is a schematic illustrating a front view of the mounting structure illustrated in FIG. 4.
Figure 9B:
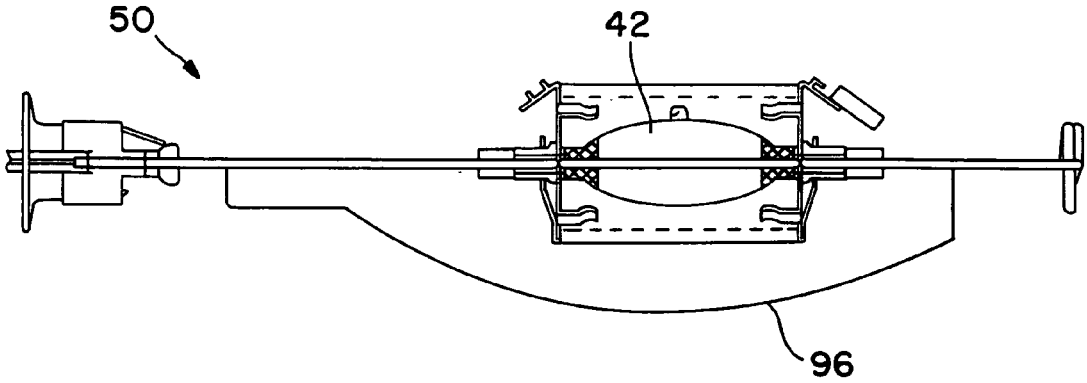
FIG. 9*b* is a bottom view of FIG. 9*a*.

FIGS. 9*a* and 9*b* illustrate the embodiment of the present invention illustrated in FIGS. 4*a* and 4*b*. With reference to FIGS. 9*a* and 9*b*, the mounting structure 50 includes the stem leads 60 which each provide electrical coupling between the arc tube 42 and a source of electrical power (not shown).

The arc tube 42 includes the arc tube lead 90 at one end and the arc tube lead 92 at the other end thereof. The connector 94 provides electrical coupling between the arc tube lead 90 and one of the stem leads 60. The connector 96 provides electrical coupling between the arc tube lead 92 and the other stem lead 60. In one embodiment of the present invention, the integrity of the electrical coupling between the arc tube leads 90,92 and the stem leads 60 may be maintained without welds.

Figure 10:
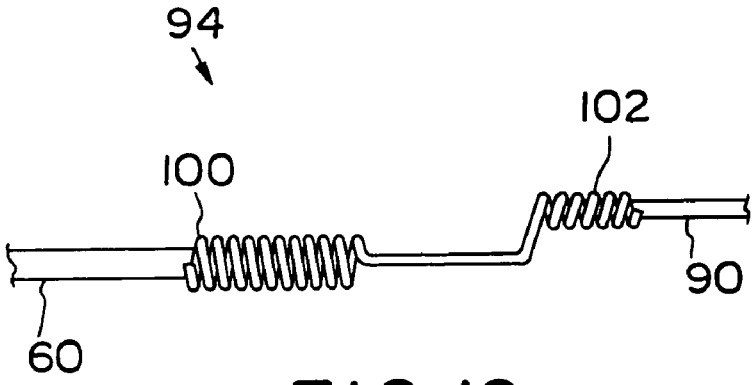
FIG. 10 is a schematic illustrating one embodiment of a wire connector according to the present invention.
Figure 11:
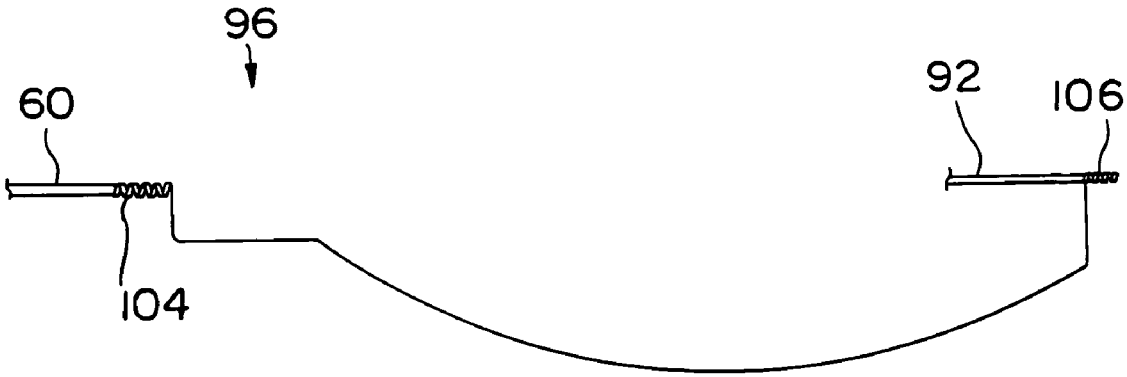
FIG. 11 is a schematic illustrating another embodiment of a wire connector according to the present invention.

FIGS. 10 and 11 each illustrate an embodiment of a connector for electrically coupling an arc tube lead to a stem lead according to the present invention. With reference to FIG. 10, the connector 94 comprises an elongated wire having a coil 100 formed at one end and a coil 102 formed at the other end thereof. The coil 100 is adapted to receive a portion adjacent the terminal end of one of the stem leads 60 therein so that the coil 100 extends axially around the portion of the stem lead 60 received therein. At least a portion of the coil 100 is crimped around the portion of the stem lead 60 received therein to establish and maintain the integrity of the electrical coupling between the connector 94 and one of the stem leads 60.

The coil 102 is adapted to receive a portion adjacent the terminal end of the arc tube lead 90 therein so that the coil 102 extends axially around the portion of the arc tube lead 90 received therein. At least a portion of the coil 102 is crimped around the portion of the arc tube lead 90 received therein to establish and maintain the integrity of the electrical coupling between the connector 94 and the arc tube lead 90. Thus the integrity of the electrical coupling between the arc tube lead 90 and one of the stem leads 60 may be maintained without a weld.

With reference to FIG. 11, the connector 96 comprises an elongated wire, commonly referred to as a flywire, having a coil 104 formed at one end and a coil 106 formed at the other end thereof. The coil 104 is adapted to receive a portion adjacent the terminal end of one of the stem leads 60 therein so that the coil 104 extends axially around the portion of the stem lead 60 received therein. At least a portion of the coil 104 is crimped around the portion of the stem lead 60 received therein to establish and maintain the integrity of the electrical coupling between the connector 96 and one of the stem leads 60.

The coil 106 is adapted to receive a portion adjacent the terminal end of the arc tube lead 92 therein so that the coil 106 extends axially around the portion of the arc tube lead 92 received therein. At least a portion of the coil 106 is crimped around the portion of the arc tube lead 92 received therein to establish and maintain the integrity of the electrical coupling between the connector 96 and the arc tube lead 92. Thus the integrity of the electrical coupling between the arc tube lead 92 and one of the stem leads 60 may be maintained without a weld.

Figure 12:
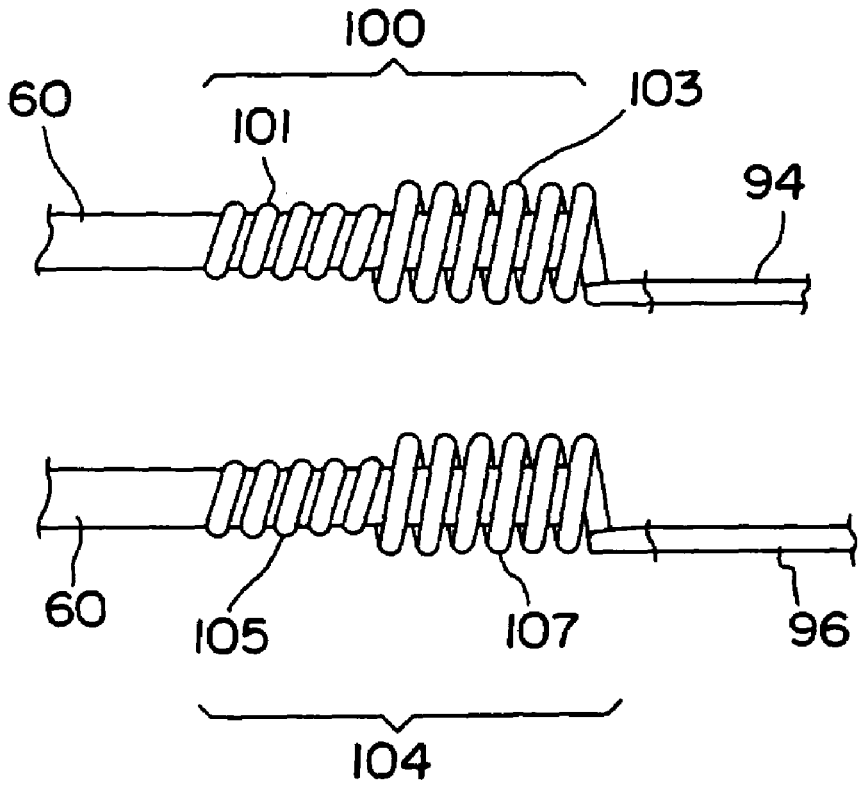
FIG. 12 is a schematic illustrating one embodiment of the electrical coupling between the wire connectors and the stem leads according to the present invention.

In the fabrication of lamps, the stem is susceptible to breakage due to its relative fragility. In the event that the stem must be replaced after the connectors 94,96 and the stem leads 60 have been electrically coupled, such electrical coupling must be suitable for uncoupling and recoupling the connectors with a new stem and stem leads. FIG. 12 illustrates an embodiment of the electrical coupling between the arc tube leads and the stem leads which is suitable for recoupling the leads. With reference to FIG. 12, the electrical coupling between the stem leads 60 and the connectors 94,96 is established and maintained by crimping only a portion 101 of the coil 100 and a portion 105 of the coil 104 sufficient to establish and maintain such electrical coupling. In the event that the crimped portions 101,105 must be removed from the connector 94,96 to uncouple the connectors 94,96 from the stem leads 60, the uncrimped portion 103 of the coil 100 and portion 107 of the coil 104 are of sufficient length so that the electrical coupling between the connectors 94,96 may be reestablished and maintained by crimping portions 103,107. Thus the arc tube 42 may be electrically uncoupled and recoupled to the stem leads 60.

Figure 13A:
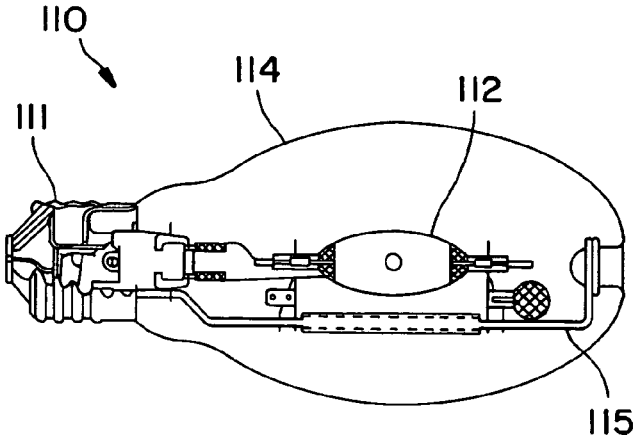
FIG. 13*a* is a schematic illustrating a front view of a 350 watt enclosed fixture metal halide lamp according to one aspect of the present invention.
Figure 13B:
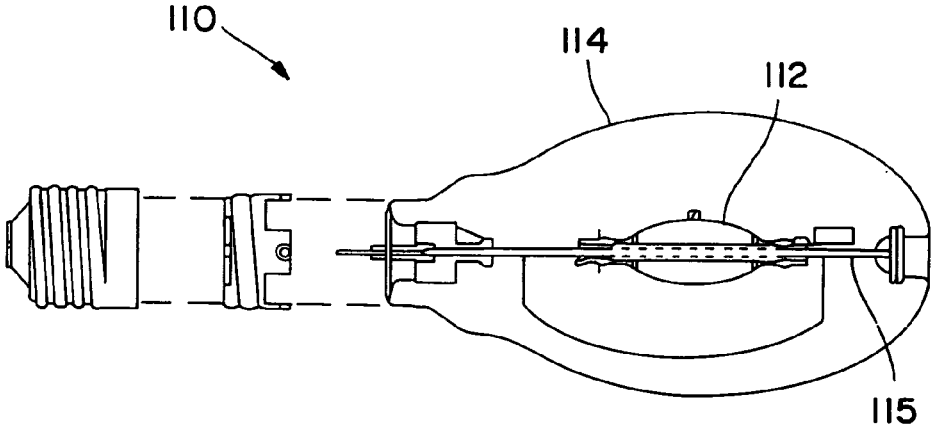
FIG. 13*b* is a bottom view of FIG. 13*a*.

Enclosed Fixture Lamps:

FIGS. 13*a* and 13*b* illustrate a 350 watt enclosed fixture (i.e. unshrouded) metal halide lamp. With reference to FIGS. 13*a* and 13*b*, the lamp 110 includes a formed body arc tube 112 which is mechanically supported and electrically coupled within the outer lamp envelope 114 by the mounting structure 115.

Figure 14A:
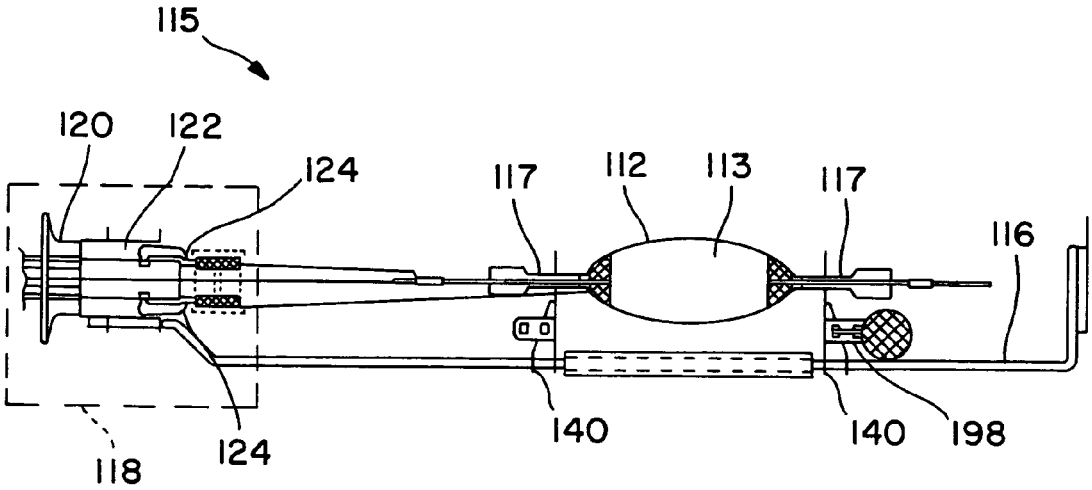
FIG. 14*a* is a schematic illustrating a front view of the mounting structure in the lamp illustrated in FIG. 13.
Figure 14B:
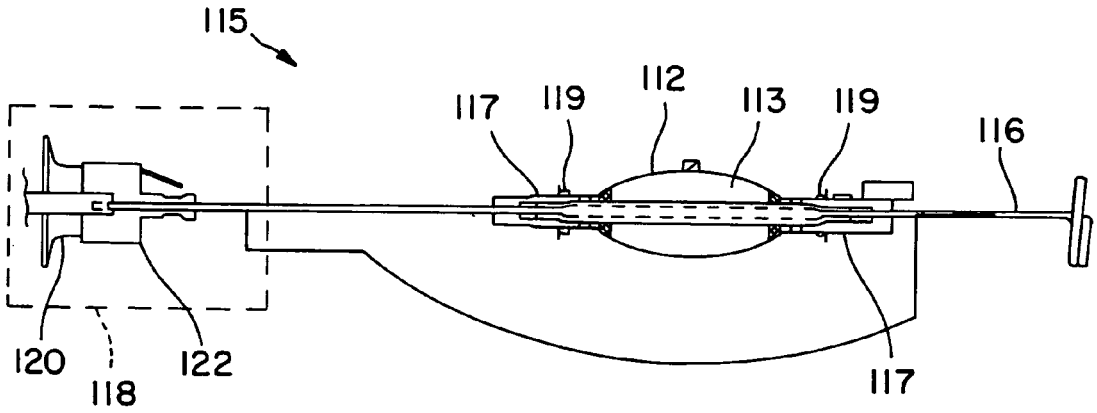
FIG. 14*b* is a bottom view of FIG. 14*a*.

FIGS. 14*a* and 14*b* illustrate the arc tube mounting structure for the lamp illustrated in FIGS. 13*a* and 13*b*. With reference to FIGS. 14*a* and 14*b*, the mounting structure 115 comprises a frame 116 which is mechanically supported by the stem assembly 118. The stem assembly 118 comprises a stem 120 which may be formed from hard glass, a metallic stem clamp 122, and two stem leads 124 which provide electrical coupling between the arc tube 112 supported within the outer lamp envelope (not shown) to a source of electrical power (not shown) for operating the lamp.

The frame 116 is mechanically supported at one end by the stem assembly 118. In one embodiment of the present invention, the integrity of the mechanical support of the frame 116 by the stem assembly 118 is maintained without a weld.

Figure 15A:
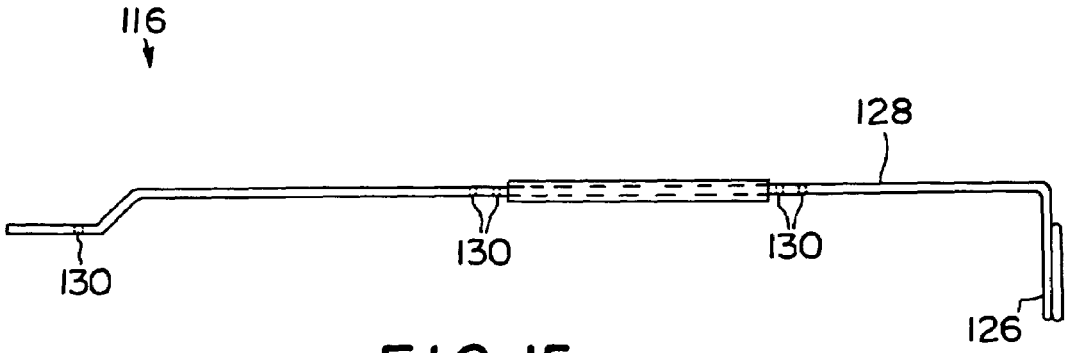
FIG. 15*a* is a schematic illustrating a front view of one embodiment of the frame suitable for the mounting structure illustrated in FIG. 14.
Figure 15B:
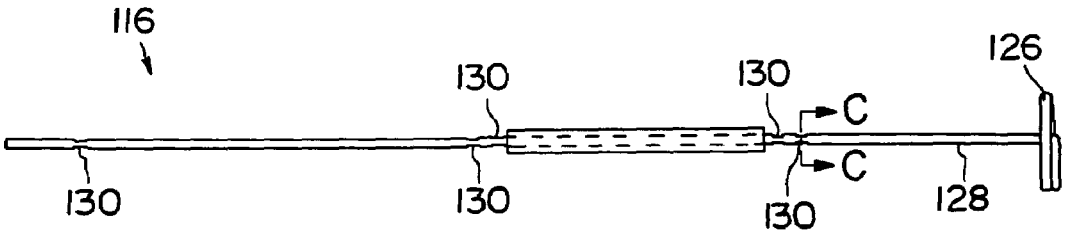
FIG. 15*b* is a bottom view of FIG. 15*a*.
Figure 15C:
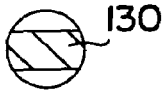
FIG. 15*c* is a section of FIG. 15*b*.

FIGS. 15*a* and 15*b* illustrate one embodiment of the frame according to the present invention. With reference to FIGS. 15*a* and 15*b*, the frame 116 comprises a metallic wire formed into an end portion 126 and an leg 128 extending therefrom. The leg 128 includes one or more swaged portions 130 at predetermined locations along the length thereof. FIG. 115*c* illustrates an enlarged cross-section of the leg 128 at a swaged portion 130 thereof.

Figure 16A:
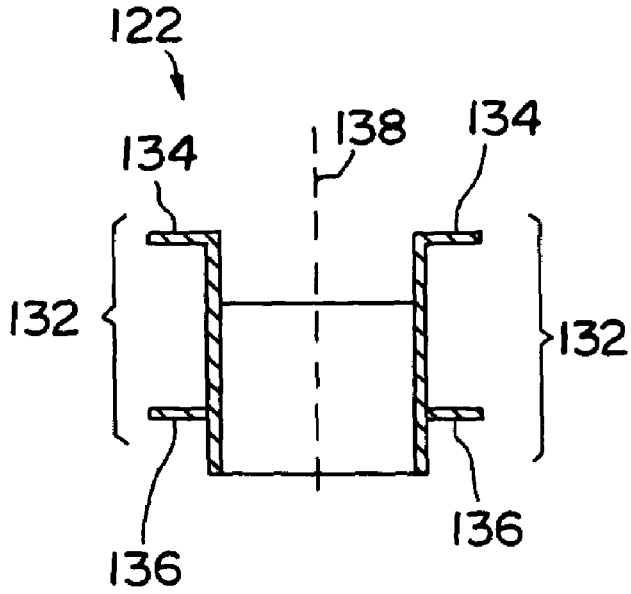
FIG. 16*a* is a schematic illustrating a front view one embodiment of a stem clamp suitable for the mounting structure illustrated in FIG. 14.
Figure 16B:
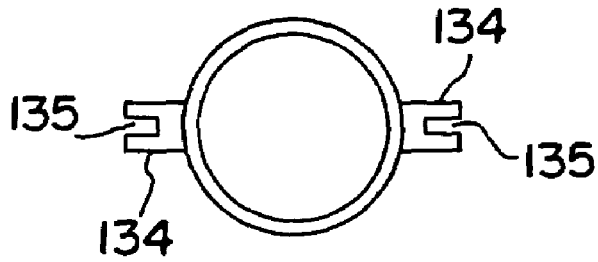
FIG. 16*b* is a top view of FIG. 16*a*.

FIGS. 16*a* and 16*b* illustrate one embodiment of the present invention suitable for mechanically supporting the frame in an enclosed fixture lamp. With reference to FIGS. 16*a* and 16*b*, the stem clamp 122 includes two pairs of frame retaining tabs 132, each pair having an upper tab 134 and a lower tab 136 and being positioned opposite the other pair about the curved surface of the stem clamp 122. Each of the lower retaining tabs 136 forms an aperture (not shown) and is adapted to receive the terminal end of the leg 128 of the frame 116 therethrough. Each of the upper tabs 134 forms a slot 135 which is adapted to receive a swaged portion 130 of the leg 128 therein. Each pair of frame retaining tabs 132 is aligned so that the leg 128 received therethrough is substantially parallel to the longitudinal axis 138 of the stem clamp 122. Because there is only one leg 128 of frame 116, only one pair of retaining tabs 132 is needed to support the frame 116. Also because there is only one leg 128, the frame 116 is susceptible to radial movement about the axis of the leg 128. Thus the slot 135 must also be adapted to constrain such radial movement of the frame 116 by preventing rotation of the swaged portion 130 received therein.

The frame 116 may be mechanically supported by the stem assembly 118 by positioning the terminal end of the leg 128 through the aperture formed by the lower tab 136 and positioning the swaged portion 130 nearest the terminal end of the leg 128 into the slot 135 formed by the corresponding upper tab 134. The tabs 134,136 laterally constrain the terminal end of the leg 128. The integrity of the mechanical support may be maintained by crimping the upper tabs 134 about the portion of the leg 128 received therein.

With further reference to FIG. 13*a*, the rigid connection between the outer lamp envelope 114 and the lamp base 111 axially constrains the mounting structure 115 and thus the frame 116 supported therein. Thus the integrity of the mechanical support is further maintained by the axial constraint of the frame 116 and may include no welds.

With further reference to FIGS. 14*a*, 14*b*, 15*a* and 15*b*, the arc tube 112 may be mechanically supported at each end by an arc tube clip 140. Each arc tube clip 140 is mechanically supported by the frame 116. In one embodiment of the present invention, the integrity of the mechanical support of one or both arc tube clips 140 may be maintained without a weld.

Figure 17A:
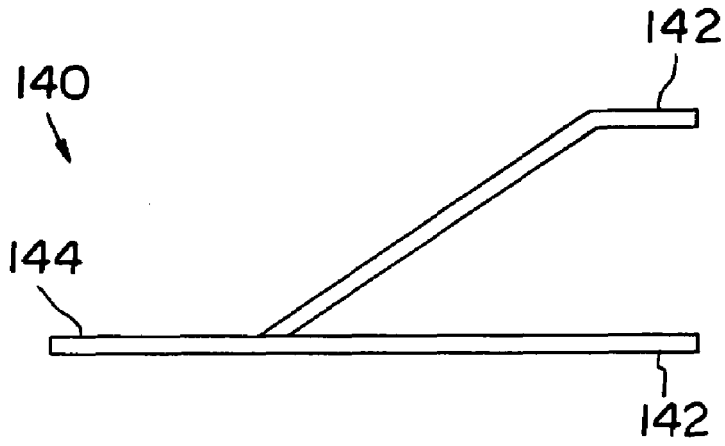
FIG. 17*a* is a schematic illustrating a front view of one embodiment of an arc tube clip suitable for the mounting structure illustrated in FIG. 14.
Figure 17B:
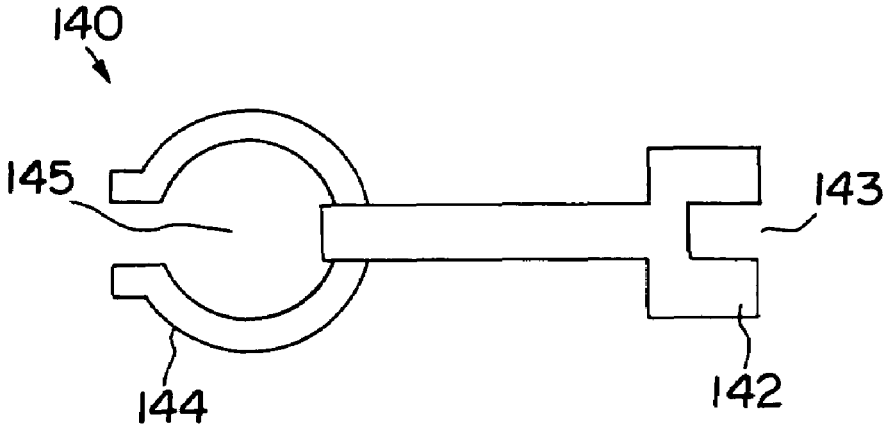
FIG. 17*b* is a bottom view of FIG. 17*a*.

FIGS. 17*a* and 17*b* illustrate an arc tube clip of one embodiment of the present invention. With reference to FIGS. 17*a* and 17*b*, the arc tube clip 140 is a substantially rigid member comprising a pair of frame receiving tabs 142 at one end and an arc tube receiving tab 144 at the other end thereof.

Each frame receiving tab 142 forms a slot 143 which is adapted to receive therein a swaged portion 130 of the leg 128 of the frame 116. The integrity of the mechanical support of the arc tube clips 140 may be maintained by crimping the tabs 142 about the swaged portion 130 received therein. Thus the integrity of the mechanical support of one or both of the arc tube clips 140 from the frame 116 may be maintained without a weld.

With further reference to FIGS. 14*a* and 14*b*, the arc tube 112 includes a bulbous light emitting chamber 113 between two end portions 117. The arc tube 112 may be supported at each end portion 117 by the arc tube retaining tab 144 of one of the arc tube clips 140. Each tab 144 forms a slot 145 adapted to receive a portion of one end portion 117 of the arc tube 112 therethrough. The arc tube 112 is positioned between the tabs 144 of each arc tube clip 140 so that the longitudinal axis of the arc tube 112 is substantially parallel to the leg 128 of the frame 116.

Each end portion 117 may include an axial positioning portion 119 which is of larger cross-sectional dimension than the end portion 117. The cross-sectional dimension of portions 119 is large enough the prevent the passage of portions 119 through the slots 145. Thus the arc tube clips 140 may be spaced apart a distance to prevent axial movement of the arc tube 112 supported therebetween.

The light center of the lamp 110 may be determined by positioning the swaged portions 130 along the length of the leg 128.

Figure 18:
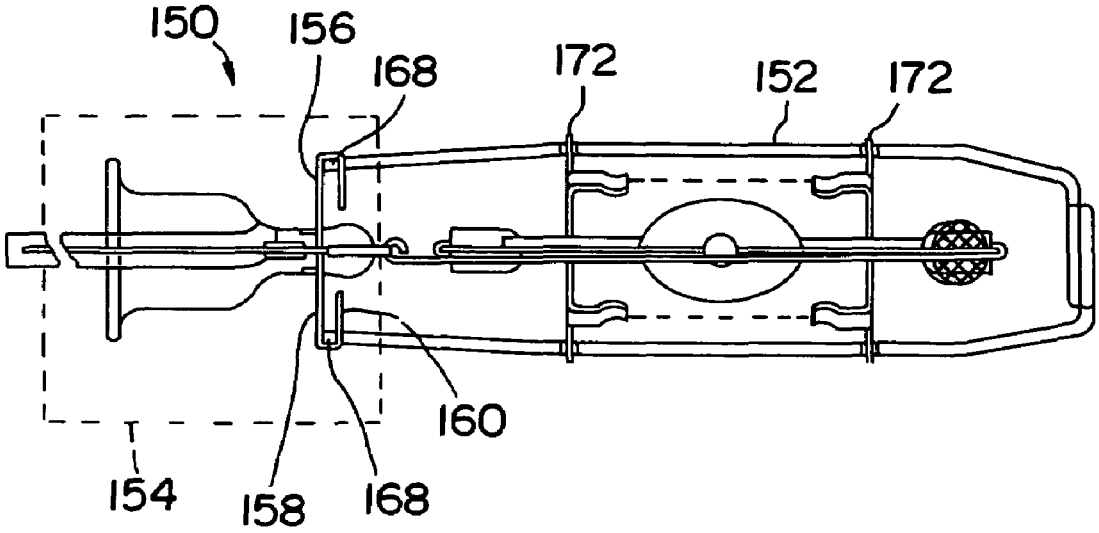
FIG. 18 is a schematic illustrating a front view of one embodiment of a mounting structure suitable for a medium base lamp according to the present invention.

Metal halide lamps of lower wattage (i.e. about 150 W and below) typically include a medium type base. FIG. 18 illustrates a mounting structure for a metal halide lamp having a medium type base. With reference to FIG. 18, the mounting structure 150 includes a frame 152 and a stem assembly 154 comprising a heat shield 156. The frame 152 is mechanically supported by the heat shield 156.

Figure 19A:
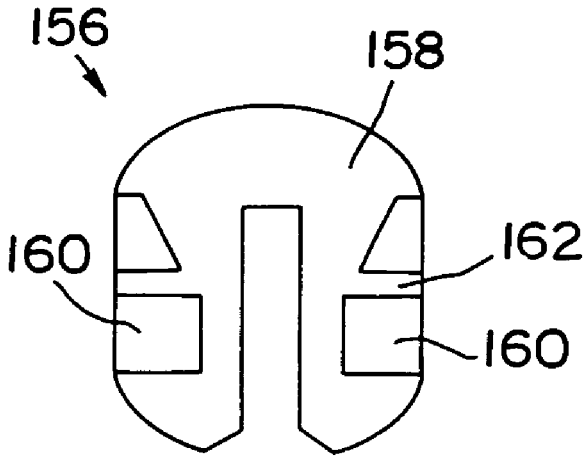
FIG. 19*a* is a schematic illustrating a side view one embodiment of a heat shield suitable for the mounting structure illustrated in FIG. 18.
Figure 19B:
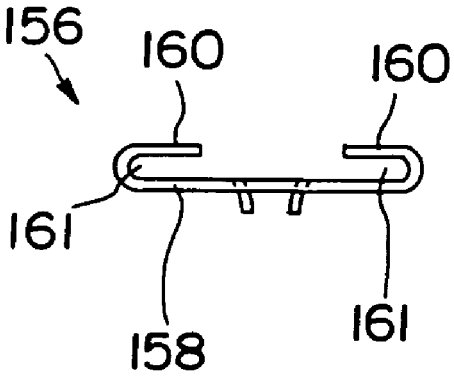
FIG. 19*b* is a bottom view of FIG. 19*a*.

FIGS. 19*a* and 19*b* illustrate one embodiment of the heat shield according to the present invention. With reference to FIGS. 19*a* and 19*b*, the heat shield 156 comprises a generally planar shield portion 158 and a pair of frame retaining tabs 160 positioned on opposites sides of the shield portion 158. Each of the retaining tabs 160 overlies a portion of the shield portion 158 forming a gap 161. Each of the retaining tabs 160 also forms a slot 162.

Figure 20:
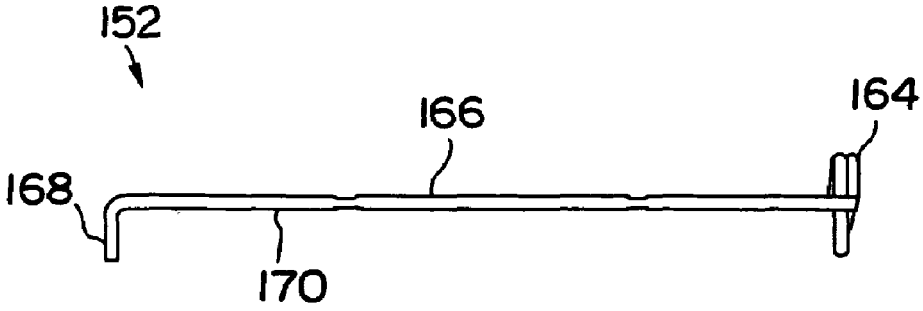
FIG. 20 is a schematic illustrating a bottom view of one embodiment of the frame suitable for the mounting structure illustrated in FIG. 18.

FIG. 20 illustrates the frame 152. With reference to FIG. 20, the frame 152 comprises a wire formed into and end portion 164 and a pair of substantially parallel legs 166 extending in the same direction from the end portion 164. Each leg 166 terminates in a terminal portion 168 extending at a substantially right angle from the major portion 170 of the leg 166.

Each of the slots 162 is adapted to receive one of the legs 166 therein at the portion of the leg 166 adjacent the terminal portion 168. Each of the gaps 161 is adapted to receive therein the terminal portion 168 of the leg 166 received in the adjacent slot 162. The tabs 160 may be crimped to retain the terminal portions 168 received in the gaps 161.

With further reference to FIG. 18, the shroud cap 172 has a dimension normal to the legs 166 which is larger than the corresponding dimension of the heat shield 156. Thus the terminal portions 168 of the legs 166 are compressed toward the each other when received within the gaps 161 formed in the heat shield 156. The crimping of the tabs 160 about the terminal portions 168 received therein maintains the integrity of the mechanical support of the frame 152 by the stem assembly 154 without a weld. The mechanical support is further enhanced by the resistance of the legs 166 to the compression of the terminal portions, as well as the frictional engagement between the heat shield 156 and the legs 166 received therein. In some embodiments, crimping of the tabs 160 may not be necessary.

Figure 21:
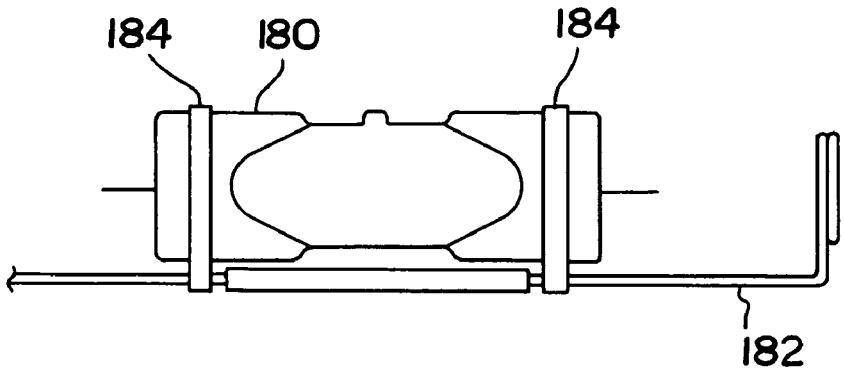
FIG. 21 is a schematic illustrating a front view of a portion of a mounting structure for a pinched body arc tube.
Figure 22A:
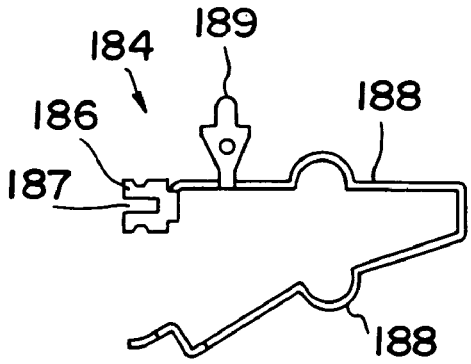
FIG. 22*a* is a schematic illustrating a side view of one embodiment of the arc tube clip suitable for the mounting structure illustrated in FIG. 21.
Figure 22B:
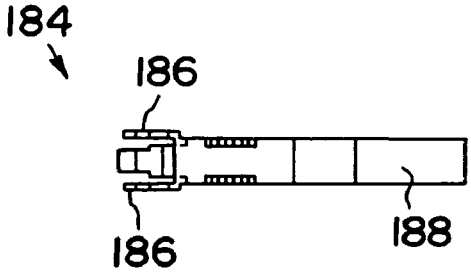
FIG. 22*b* is a bottom view of FIG. 22*a*.

The present invention is suitable for supporting pinched body arc tube as well as formed body arc tubes. FIG. 21 illustrates one embodiment of the present invention suitable for supporting a pinched body arc tube. With reference to FIG. 21, the arc tube 180 is supported at each end from the frame 182 by an arc tube clip 184. FIGS. 22*a* and 22*b* illustrate one embodiment of the arc tube clip suitable for supporting a pinched body arc tube from the frame. With reference to FIGS. 22*a* and 22*b*, the arc tube clip 184 includes a pair of frame retaining tabs 186 at one end. Each frame retaining tab 186 forms a slot 187 adapted to receive a swaged portion of the frame 182 therein. The tabs 186 may be crimped to maintain the integrity of the mechanical support of the arc tube clip 184 from the frame 182.

The arc tube clip 184 further includes a pair of arc tube clamping portions 188 adapted to receive one pinched end of the arc tube 180 therebetween. The pinched end of the arc tube may be retained between the clamping portions 188 by compressing the clamping portions 188 around the pinched end of the arc tube and securing the tab 189 behind the frame received in the slots 187 formed by the frame retaining tabs 186.

In many HID lamps it is desirable to getter excess gasses such as hydrogen and oxygen from within the outer lamp envelope. Typically a getter material is mounted within the outer lamp envelope by welding a getter cap to the lamp mounting structure. In yet another aspect of the present invention, the getter cap may be supported within the outer lamp envelope with no welds between the getter cap and the mounting structure.

Figure 23:
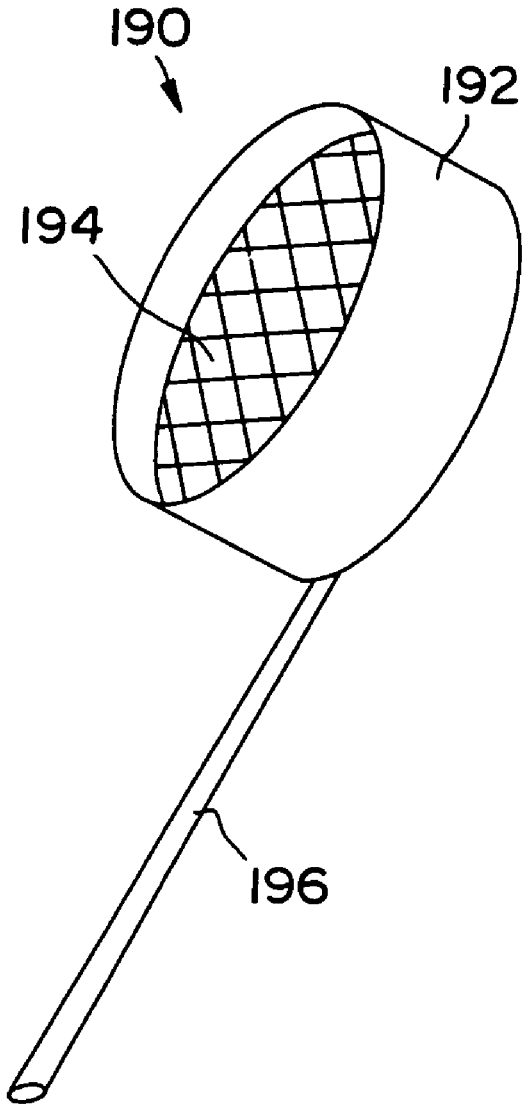
FIG. 23 illustrates a prior art getter cap.

FIG. 23 illustrates a typical getter cap. With reference to FIG. 23, the getter cap 190 comprises a getter containing portion 192 which contains the getter material 194. A getter cap mounting wire 196 is typically attached at one end to the getter containing portion 192 by a weld. The getter cap 190 is typically supported by a lamp mounting structure by welding the other end to the mounting wire 196 to the structure. In one embodiment of the present invention, the getter cap 190 may be supported from the lamp mount by providing a getter mount tab such as tabs 197,198,199 illustrated in FIGS. 9*a*, 14*a*, and 22*a* respectively, feeding the distal end of the mounting wire 196 through one or more apertures formed by the tab 197 or tab 198 or tab 199, and wrapping the end of the wire 196 around a portion of the tab.

Thus the getter cap may be supported by the mounting structure without a weld between the getter cap and the structure.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof

What is claimed is:

1. In a structure for mounting an arc tube within the outer envelope of an HID lamp, the structure including an elongated frame supported at one end by a stem assembly, the improvement comprising a stem clamp having one or more frame retaining tabs crimped around a portion of said frame.

2. The structure of claim 1 wherein said stem assembly comprises:

i. a stem adapted to be supported by the base of the lamp, and ii. a stem clamp supported by said stem, said stem clamp comprising one or more frame retaining tabs, wherein said frame is supported at one end by frictional engagement with one or more of said frame retaining tabs.

3. The mounting structure of claim 2 wherein said frame comprises a wire forming an end portion and two substantially parallel legs extending in substantially the same direction from said end portion.

4. The mounting structure of claim 2 wherein said stem clamp comprises a generally tubular member having two pair of frame retaining tabs, each pair of tabs being positioned opposite the other about the curved surface of said stem clamp, each of said tabs forming an opening adapted to receive a portion of said frame therethrough.

5. The mounting structure of claim 4 wherein said frame comprises a wire forming an end portion and two substantially parallel legs extending in substantially the same direction from said end portion, a portion of one of said legs being received through the openings formed by one pair of said frame retaining tabs, a portion of the other of said legs being received through the openings formed by the other pair of said frame retaining tabs.

6. The mounting apparatus of claim 4 wherein each of said tabs forms an aperture.

7. The mounting structure of claim 2 wherein said frame comprises a wire forming an end portion and a leg extending from said end portion, said leg having a swaged portion adjacent a terminal end thereof.

8. The mounting structure of claim 2 wherein said stem clamp comprises a generally tubular member having a pair of frame retaining tabs, each of said tabs forming an opening adapted to receive a portion of said frame therethrough.

9. The mounting structure of claim 8 wherein one of said tabs forms an aperture and the other of said tabs forms a slot.

10. The mounting structure of claim 9 wherein said frame comprises a wire forming an end portion and a leg extending from said end portion, said leg having a swaged portion adjacent the terminal end thereof, a portion of said leg being received through said aperture and said swaged portion being received in said slot.

11. The structure of claim 2 wherein one or more of said frame retaining tabs comprise a slot for receiving a portion of said frame.

12. The structure of claim 2 wherein said stem clamp comprises a curved portion and two pair of frame retaining tabs extending radially outward from said curved surface, each of said tabs forming a slot for receiving a portion of said frame therein.

13. The mounting structure of claim 1 wherein said frame comprises a pair of substantially parallel elongated legs, each of said legs having a tab retaining portion adjacent a terminal end thereof; and said stem assembly comprises:

i. a stem adapted to be supported by the base of the lamp, and ii. a heat shield supported by said stem, said heat shield comprising a pair of frame retaining tabs, wherein said frame is supported at one end by engagement of one of said tab retaining portions thereof with one of said frame retaining tabs and the other of said tab retaining portions thereof with the other of said frame retaining tabs.

14. The mounting structure of claim 13 wherein said heat shield comprises a generally planar shield portion and said pair of frame retaining tabs formed on opposite sides of said shield portion, each of said tabs overlying a portion of said shield portion forming a gap therebetween, one of said gaps retaining therein the tab retaining portion of one of said legs and the other of said gaps retaining therein the tab retaining portion of the other of said legs, each of said tabs forming a slot receiving therein a portion of said leg adjacent the tab retaining portion thereof.

15. The structure of claim 1 wherein a portion of said frame is laterally received in one or more frame retaining tabs.

* * * * *